US005398493A

United States Patent [19]

Onishi et al.

[11] Patent Number: 5,398,493

[45] Date of Patent: Mar. 21, 1995

[54] SPINDLE DEVICE CAPABLE OF ELIMINATING A ROTATIONAL DRIVE MECHANISM FOR A TUBULAR SPINDLE BY USING A SPINNING STREAM OF COMPRESSED AIR

[75] Inventors: Masayoshi Onishi, Sakai; Takeshi Takahashi, Yamatotakada, both of Japan

[73] Assignee: Koyo Seiko Co., Ltd., Osaka, Japan

[21] Appl. No.: 97,203

[22] Filed: Jul. 27, 1993

[30] Foreign Application Priority Data

Jul. 28, 1992 [JP] Japan ..... 4-201100

[51] Int. Cl.[6] ..... D01H 1/115

[52] U.S. Cl. ..... 57/328; 57/333; 57/343

[58] Field of Search ..... 57/328, 333, 343, 344, 57/346

[56] References Cited

U.S. PATENT DOCUMENTS 4,034,546 7/1977 Hashizume ..... 57/346
4,121,411 10/1978 Shindo et al. ..... 57/333
4,827,710 5/1989 Nishimura ..... 57/328
4,845,932 7/1989 Sakai et al. ..... 57/328 X

FOREIGN PATENT DOCUMENTS 0406720 1/1991 European Pat. Off. .

*Primary Examiner*—Joseph J. Hail, III
*Attorney, Agent, or Firm*—Wenderoth, Lind & Ponack

[57] ABSTRACT

There is provided a spindle device for use in a spinning machine which produces little noise, which can eliminate the need for a rotational drive mechanism for a tubular spindle, for which bearing life is prolonged, and which can prevent waste threads from invading inside the bearings. A tubular spindle accommodated in a housing is rotatably supported by static-pressure pneumatic bearings. A cap, having nozzles and forming a spinning stream of air therein with compressed air blown off through the nozzles, is disposed at the tip portion of the tubular spindle. The tubular spindle radially supported by a film of air blown out through the static-pressure pneumatic bearings is rotated by the spinning stream of compressed air formed in the cap.

14 Claims, 3 Drawing Sheets

SPINDLE DEVICE CAPABLE OF ELIMINATING A ROTATIONAL DRIVE MECHANISM FOR A TUBULAR SPINDLE BY USING A SPINNING STREAM OF COMPRESSED AIR

BACKGROUND OF THE INVENTION

1. Field of the Invention

The present invention relates to spindle devices for spinning machines and, more particularly, to a spindle device for a spinning machine of the pneumatic type, in which a twisting force is applied to roves with a spinning stream of compressed air and thereafter the roves are passed through a rotating thin tube to be spun.

2. Description of the Prior Art

A spindle device as shown in FIG. 4 has hitherto been known as the above-mentioned type of spindle device. This spindle device is so arranged that a small-diameter tubular spindle 1 is rotatably installed in a housing 2 via a pair of rolling bearings 3, and a cap 5 having a plurality of nozzles 4 for spouting jet air is provided at a tip portion of the tubular spindle 1. The tubular spindle 1 is driven to rotate by a motor comprised of a rotor 6 secured to the tubular spindle 1 and a stator 7 secured to the housing 2. The nozzles 4, provided in a peripheral wall 5*a* of the cap 5 as shown in FIG. 2, makes a spinning stream within the cap with jet air spouted from the nozzles 4. Then, this spinning stream of jet air gives a twisting force to roves 9 introduced into the cap 5 through an inlet 8, the roves 9 being then further twisted and passed within the tubular spindle 1 rotated by the motor to be spun. A thread 9' thus fabricated is wound up around a roll, which is not shown.

As another available method for driving the tubular spindle 1, the motor comprised of the stator 7 and the rotor 6 may be substituted by an arrangement in which an external motor and the tubular spindle 1 are connected to each other with a belt.

However, in the above-described prior-art spindle device for use in a spinning machine, one problem is that there is a need for providing a rotational drive mechanism for the tubular spindle 1, resulting in a large size device as a whole, while the motor act as noise source, causing great noise. Another problem is that the rolling bearings 3 supporting the tubular spindle 1 cause metal-to-metal rolling friction such that the bearings 3 are susceptible to damage, resulting in a shorter life. Yet another problem is that waste threads floating around the tubular spindle 1 can invade inside the rolling bearings 3.

SUMMARY OF THE INVENTION

The object of the present invention is therefore to provide a spindle device for use in a spinning machine which produces less noise, which can eliminate the need for a rotational drive mechanism for a tubular spindle, prolong the life of a bearing, and which can prevent waste threads from invading inside the bearing.

In order to achieve the aforementioned object, there is provided a spindle device for use in a spinning machine, comprising: a tubular spindle accommodated in a housing; a cap disposed in the vicinity of a tip portion of the tubular spindle, having a rove inlet and a nozzle, and serving form a spinning stream of air on the tip portion of the tubular spindle and around roves supplied from the rove inlet to the tubular spindle with compressed air blown off from the nozzle; and a static-pressure pneumatic bearing for rotatably supporting the tubular spindle.

It is desirable for a flange to be provided on the periphery of the tubular spindle so that air supplied from the static-pressure pneumatic bearing is exhausted outside through spacing between an end face of the flange and an end face of the static-pressure pneumatic bearing.

It is also desirable for an air escape hole to be provided within the static-pressure pneumatic bearing in the axial direction so that air is exhausted outside.

The tubular spindle is supported by the static-pressure pneumatic bearing so as to float within the housing. As a result, the tubular spindle is rotatable at a very low torque. In this state, when a spinning stream of compressed air is produced within the cap located at the tip of the tubular spindle, the tubular spindle is rotated by this spinning stream. Accordingly, there is no need for separately providing a rotational drive mechanism for the tubular spindle. Also, since no use of the rotational drive mechanism such as a motor and so on is required, no loud noise will be present during operation. Further, the static-pressure pneumatic bearing is arranged to support the rotating tubular spindle indirectly via an air film, causing no friction, unlike the rolling bearing, and resulting in a prolonged service life of the bearing.

Roves introduced into the cap through the rove inlet are twisted by the spinning stream formed within the cap, and then passed within the rotating tubular spindle 1 while being further twisted, so as to be spun into thread products. In these processes, since air is blown outside from the static-pressure pneumatic bearing, any foreign matter, such as waste threads, is prevented from invading inside the bearing.

When a flange is provided on the periphery of the tubular spindle to allow the air supplied from the static-pressure pneumatic bearing to be exhausted outside through the spacing between the end face of the flange and the end face of the static-pressure pneumatic bearing, an air layer is formed between the end face of the flange and the end face of the static-pressure pneumatic bearing. The air layer serves to support the flange in the axial direction, whereby the tubular spindle is maintained in a regular position in the axial direction.

Further, when the air escape hole is provided within the static-pressure pneumatic bearing in the axial direction to exhaust air outside, it is no longer necessary to provide escape holes on the periphery of the housing. Accordingly, it is also unnecessary to ensure a way for air to escape in the vicinity of the periphery of the housing, which permits the periphery of the housing to lend itself to attachment of other members.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
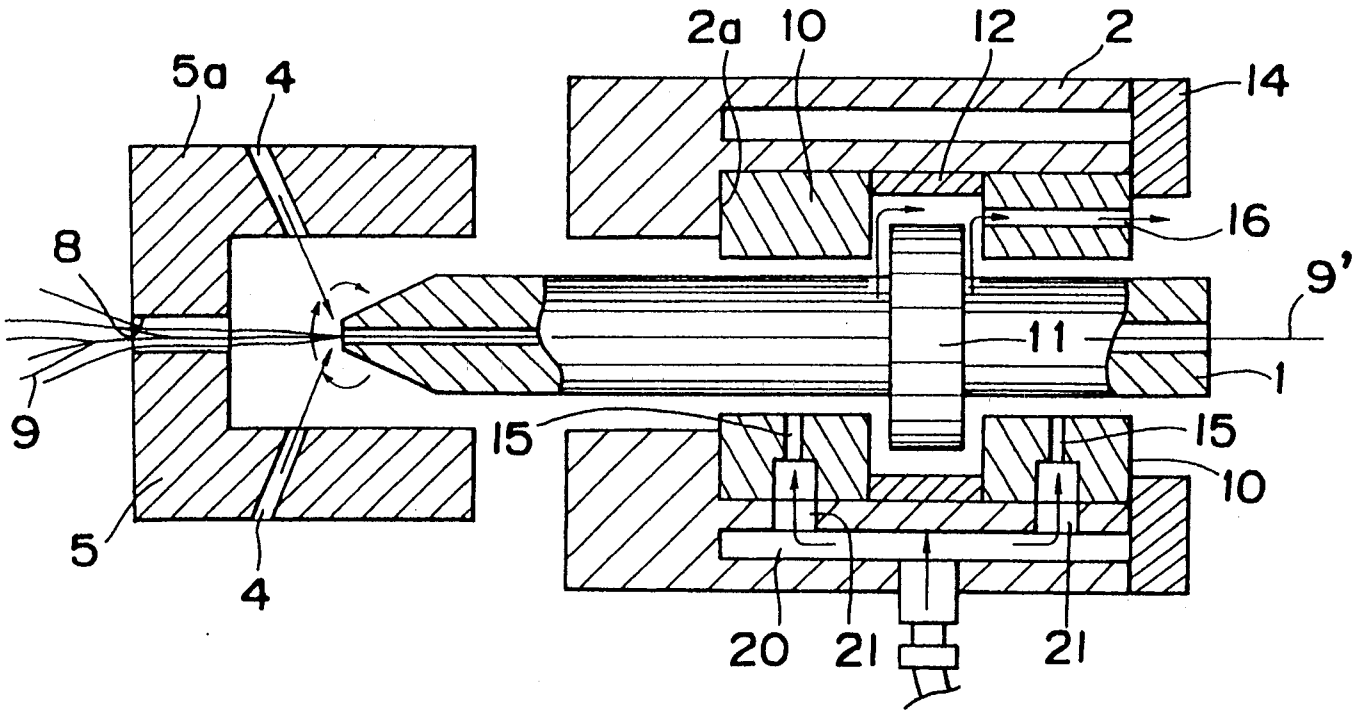
FIG. 1 is a sectional view of a spindle device for use in a spinning machine of an embodiment of the present invention.
Figure 2:
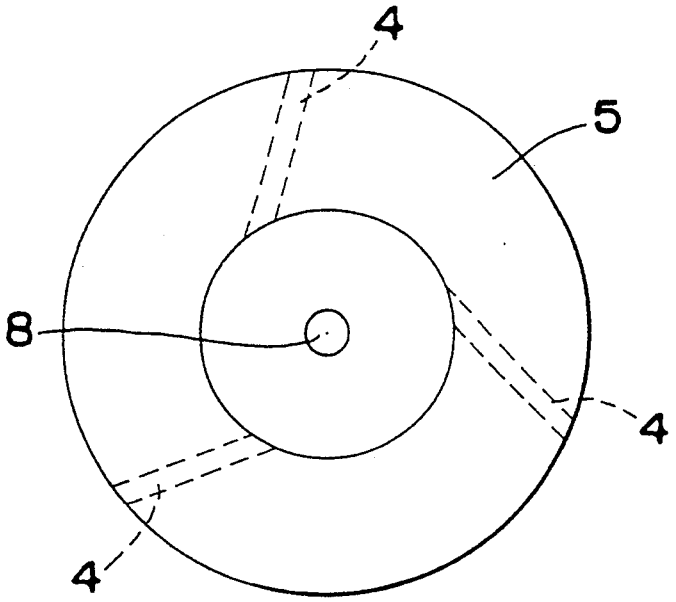
FIG. 2 is a front view of a cap of the spinning device of FIG. 1 as viewed from its open end side.
Figure 4:
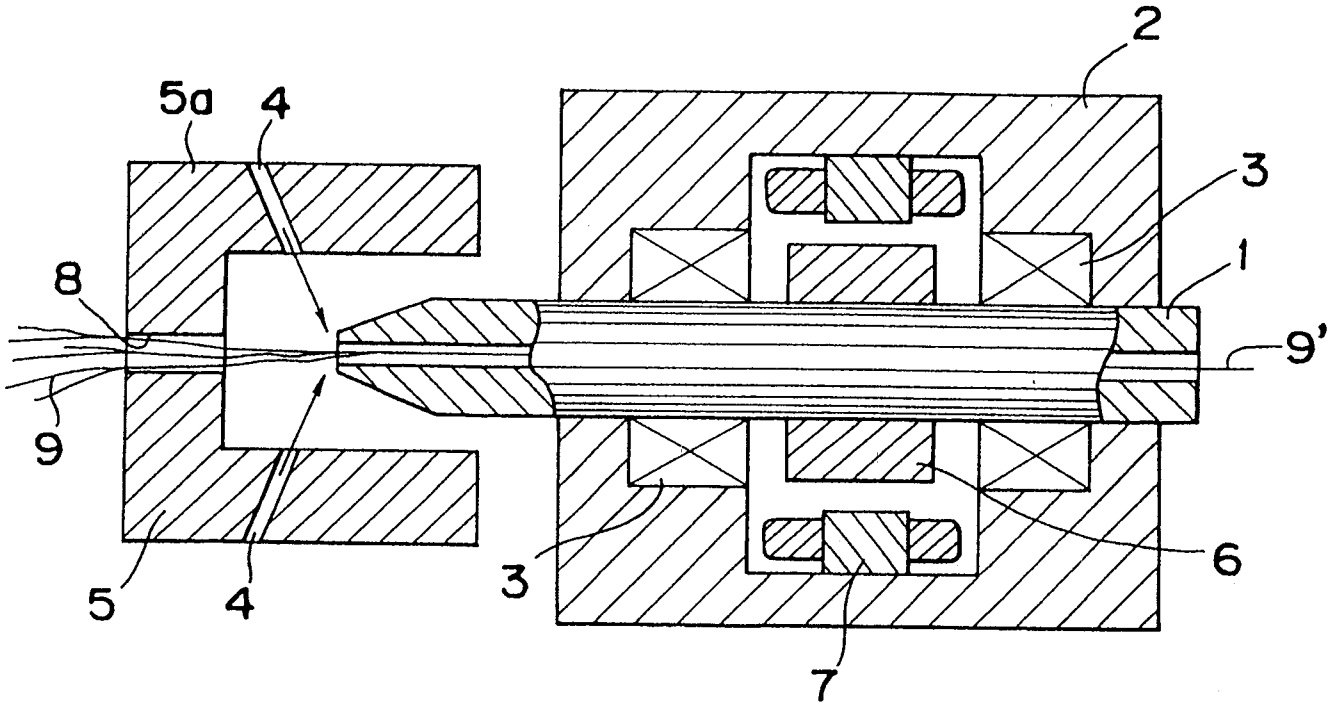
Fig. 4 PRIOR ART
FIG. 4 is a sectional view of a conventional spindle device for use in a spinning machine.

FIG. 1 is a sectional view of a spindle device for use in a spinning machine of an embodiment of the present invention, where like parts as shown in FIG. 4 are designated by like numerals as used in FIG. 4. The spindle device for use in a spinning machine according to the present invention has a small-diameter tubular spindle 1 rotatably accommodated in a housing 2 and having a flange 11 on its peripheral surface. At the tip portion of the tubular spindle 1 a cap 5 is provided such that a spinning stream of jet air is to be formed inside the caps, in such a way that the cap 5 surrounds the tip portion of the tubular spindle 1. The cap 5 is similar to that used in the aforementioned prior-art spindle device for use in a spinning machine. As shown in FIGS. 1 and 2, the cap 5 has an inlet 8 for introducing roves 9 at a portion opposite to the tubular spindle 1 in the axial direction, and also has a plurality of nozzles 4 provided at specified intervals in a peripheral wall 5*a* of the cap 5 (although three nozzles 4 have been provided in this embodiment, the number of nozzles 4 is not limited to this). Jet air is spouted from these nozzles 4 nearly along a fixed rotating direction, thereby forming a spinning stream of jet air inside the cap 5.

The tubular spindle 1 is supported by a pair of static-pressure pneumatic bearings 10 press-fitted into the inner peripheral surface of the housing 2. The pair of static-pressure pneumatic bearings 10 are positioned by a spacer 12 so as to be spaced apart from each other at a fixed interval in the axial direction with one of the paired static-pressure pneumatic bearings 10 in contact with a step portion 2*a* of the inner peripheral surface of the housing 2 and the other of the paired static-pressure pneumatic bearings 10 pressed against the spacer 12 by an annular plate 14 attached to an end portion of the housing 2. Further, the flange 11 of the tubular spindle 1 is located between the pair of static-pressure pneumatic bearings 10, the arrangement being such that air is allowed to pass through spacing between end faces of the flange 11 and their respectively opposing end faces of the static-pressure pneumatic bearings 10 to be exhausted through escape holes, which will be described later.

Figure 3:
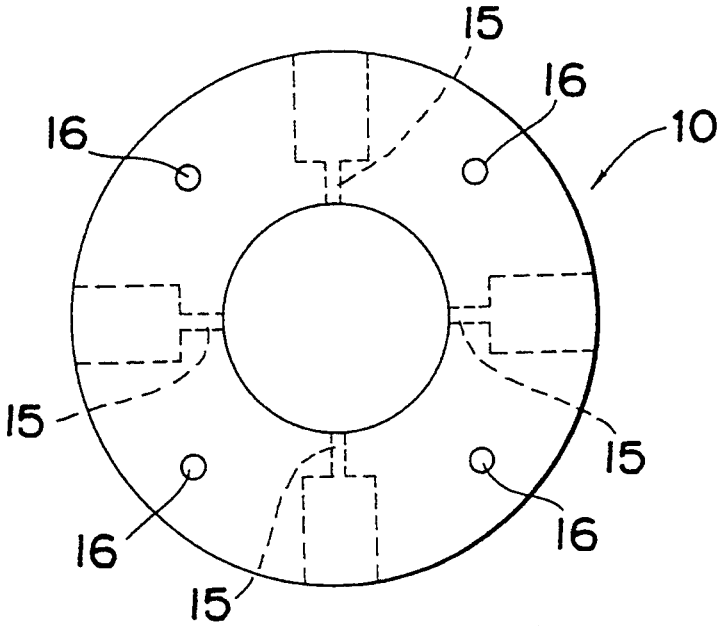
FIG. 3 is a front view of a static-pressure pneumatic bearing provided on the outer end side of the spindle device for use in a spinning machine of FIG. 1.

The static-pressure pneumatic bearings 10 are provided with a plurality of nozzles 15 spaced at specified intervals in the circumferential direction, as shown in FIG. 3. These nozzles 15, which are communicated via holes 21, 21 with an annular bore provided within the housing 2 as a passage 20 for air supplied from outside of the housing 2, blow off air supplied through the passage 20 from outside of the housing 2 toward the tubular spindle 1. In addition, an opening formed through an end face of the housing 2 by the passage 20 is closed by the annular plate 14.

Further, a plurality of air escape holes 16 are provided to one static-pressure pneumatic bearing 10 on the annular plate 14 side so as to penetrate therethrough. These air escape holes 16 are located between adjoining nozzles 15, as shown in FIG. 3. Such air escape holes may alternatively be provided on the periphery of the housing 2. However, providing the escape holes 16 within a static-pressure pneumatic bearing 10 in the axial direction offers an advantage that there is no need of ensuring a way for air to escape in the vicinity of the periphery of the housing 2, which would be required if they were provided on the periphery of the housing 2, with the result that the periphery of the housing 2 can be utilized for attachment of other members. Also, if the escape holes 16 were provided on the periphery of the housing 2, through holes should be provided not only for the housing 2 but also for the spacer 12. In this embodiment, by contrast, only the static-pressure pneumatic bearing 10 needs to be provided with the escape holes 16, simplifying the hole making process.

The spindle device having the above-described construction operates as follows. When compressed air is blown out from the nozzles 15 of the static-pressure pneumatic bearings 10 toward the tubular spindle 1, the tubular spindle 1 is supported by the resulting air film so as to be float. Meanwhile, a spinning stream of jet air spouted from the nozzles 4 is formed inside the cap 5 located at the tip portion of the tubular spindle 1. Since the tubular spindle 1 is supported by the air film, it is rotatable at a very low torque, such that it rotates only with the air spinning stream. Then, when roves 9 are introduced from the inlet 8 of the cap 5, they are given a twisting force by the air spinning stream inside the cap 5, and thereafter pass forward within the rotating tubular spindle 1 while being further twisted. The resulting spun thread 9' is wound up around a roller, which is not shown.

In the device of the present embodiment, the air spinning stream formed inside the cap 5 is consequently used for both spinning roves and driving the tubular spindle 1. Accordingly, there is no need for separately providing a drive mechanism for rotationally driving the tubular spindle 1, which would be necessitated in the prior art, such that the number of parts can be reduced and the device can be miniaturized as a whole. Also, since no motor is used, no loud noise will occur. Since the static-pressure pneumatic bearings 10 that will cause no metal-to-metal friction are used as the means for supporting the tubular spindle 1, the life of the bearing itself can be prolonged. Further, since air is blown out from the inside of the bearings 10 to outside, waste threads that appear nearby will not invade inside the bearing 10.

Air to be exhausted outside through the air escape holes 16 passes through the spacing between the end faces of the flange 11 and the respectively opposing end faces of the static-pressure pneumatic bearings 10, an air film is formed on both sides of the flange 11. By this air film, the flange 11 and therefore the tubular spindle 1 are supported in the axial direction, so that the tubular spindle 1 can be maintained in position in the axial direction.

As apparent from the foregoing description, the spindle device for use in a spinning machine of the present invention is so arranged that a static-pressure pneumatic bearing is used as a bearing for supporting a tubular spindle, and a cap for forming a spinning stream of compressed air that serves for spinning roves is disposed at the tip portion of the tubular spindle. In this arrangement, the tubular spindle is supported by an air film, allowing the tubular spindle to be rotated at a very low torque. Accordingly, the tubular spindle can be rotated by the spinning stream of compressed air used for spinning roves. As a result, there is no need for separately providing a drive mechanism including a motor and other elements. This results in a reduced number of parts, reduced size of the device itself, and also reduced cost. Moreover, there is no source of loud noise such as a motor, permitting a low-noise device to be realized. The static-pressure pneumatic bearings, which support the tubular spindle via an air film, are free from metal-to-metal friction and therefore from damage due to such friction, which would occur in rolling bearings, thus being prolonged in service life. Also, the static-pressure pneumatic bearings blow out air from inside of the bearing to outside, thus preventing waste threads from invading inside the bearings.

When a flange is provided on the periphery of the tubular spindle so that air supplied from the static-pressure pneumatic bearings is exhausted outside through the spacing between an end face of the flange and an end face of a static-pressure pneumatic bearing, the flange is supported in the axial direction by the air between the end face of the flange and the end face of the static-pressure pneumatic bearing. Thus, the flange receives a force in the axial direction, so that the tubular spindle can be maintained in position in the axial direction.

Further, when escape holes are provided in the axial direction within a static-pressure pneumatic bearing to allow air to be exhausted outside, there is no need for providing escape holes on the periphery of the housing. Thus, it is unnecessary to provide a path for air to escape in the vicinity of the periphery of the housing, permitting the periphery of the housing to be utilized for attachment of other members.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A spindle device for use in a spinning machine, comprising:

a housing;

a tubular spindle accommodated in said housing and having a tip portion;

a cap provided adjacent said tip portion of said tubular spindle and including a rove inlet and a nozzle;

a static-pressure pneumatic bearing, mounted to said housing and having an inner cylindrical surface, for rotatably supporting said tubular spindle; and wherein at least one air escape hole is formed through said static-pressure pneumatic bearing radially outwardly from said inner cylindrical surface and extending along an axial direction of said tubular spindle.

2. A spindle device as recited in claim 1, wherein said at least one air escape hole comprises a plurality of air escape holes spaced circumferentially about said static-pressure pneumatic bearing.

3. A spindle device as recited in claim 1, further comprising a flange provided about a periphery of said tubular spindle and arranged such that a first axial end face of said flange confronts an axial end face of said static-pressure pneumatic bearing, and an air exhaust space is provided between said flange and said static-pressure pneumatic bearing.

4. A spindle device as recited in claim 3, further comprising an additional static-pressure pneumatic bearing mounted to said housing and rotatably supporting said tubular spindle.

5. A spindle device as recited in claim 4, wherein an axial end face of said additional static-pressure pneumatic bearing confronts a second axial end face of said flange, and an additional air exhaust space is provided between said flange and said additional static-pressure pneumatic bearing.

6. A spindle device as recited in claim 1, wherein said static-pressure pneumatic bearing includes a plurality of air nozzles formed therethrough and directed radially toward said tubular spindle; and an annular air supply passage is formed in said housing about said spindle, said air nozzles being in communication with said annular air supply passage.

7. A spindle device as recited in claim 1, wherein said cap constitutes a means for rotating said tubular spindle relative to said housing.

8. A spindle device as recited in claim 7, wherein said cap further constitutes a means for supplying a spinning stream of air toward said tip portion of said tubular spindle to supply roves from said rove inlet into said tubular spindle.

9. A spindle device as recited in claim 1, wherein said cap constitutes a means for supplying a spinning stream of air toward said tip portion of said tubular spindle to supply roves from said rove inlet into said tubular spindle.

10. A spindle device for use in a spinning machine, comprising:

a housing;

a tubular spindle accommodated in said housing and having a tip portion;

a cap provided adjacent said tip portion of said tubular spindle and including a rove inlet and a nozzle;

a static-pressure pneumatic bearing mounted to said housing and rotatably supporting said tubular spindle; and wherein said cap constitutes substantially the sole means for rotating said tubular spindle relative to said housing during normal operation.

11. A spindle device as recited in claim 10, wherein said cap further constitutes a means for supplying a spinning stream of air toward said tip portion of said tubular spindle to supply roves from said rove inlet into said tubular spindle.

12. A spindle device as recited in claim 10, further comprising a flange provided about a periphery of said tubular spindle and arranged such that a first axial end face of said flange confronts an axial end face of said static-pressure pneumatic bearing, and an air exhaust space is provided between said flange and said static-pressure pneumatic bearing.

13. A spindle device as recited in claim 10, further comprising an additional static-pressure pneumatic bearing mounted to said housing and rotatably supporting said tubular spindle.

14. A spindle device as recited in claim 10, wherein said static-pressure pneumatic bearing includes a plurality of air nozzles formed therethrough and directed radially toward said tubular spindle; and an annular air supply passage is formed in said housing about said spindle, said air nozzles being in communication with said annular air supply passage.

* * * * *